US006230643B1

(12) United States Patent
Li

(10) Patent No.: US 6,230,643 B1
(45) Date of Patent: May 15, 2001

(54) CELL-COMBINED LARGE SIZE SEA SURFACE VEHICLE AND AIRPLANE TAKEOFF/LANDING PLATFORM

(76) Inventor: Guining Li, 13-C University Houses, Madison, WI (US) 53705

( * ) Notice: Subject to any disclaimer, the term of this patent is extended or adjusted under 35 U.S.C. 154(b) by 0 days.

(21) Appl. No.: 09/438,280

(22) Filed: Nov. 12, 1999

(51) Int. Cl.[7] ..... B63B 35/50
(52) U.S. Cl. ..... 114/261; 114/266; 244/110 E
(58) Field of Search ..... 114/261, 266, 114/258, 263; 244/110 E, 110 A

(56) References Cited

U.S. PATENT DOCUMENTS

| | | | | |
|---|---|---|---|---|
| 2,425,886 | * | 8/1947 | Knox | 244/110 E |
| 4,568,522 | * | 2/1986 | Corbett | 114/65 A |
| 4,962,716 | * | 10/1990 | Fransen et al. | 114/263 |
| 5,297,899 | * | 3/1994 | Culley | 114/266 |
| 5,398,635 | * | 3/1995 | Tellington | 114/261 |
| 5,839,693 | * | 11/1998 | Stalaw et al. | 114/261 |
| 5,906,171 | * | 5/1999 | Kristensen et al. | 114/261 |

* cited by examiner

*Primary Examiner*—Stephen Avila

(57) ABSTRACT

A large size sea surface vehicle is combined by a large number of cells that are distributed along two horizontal dimensions on sea surface. Connections of the cells are elastic and flexible to prevent destructive stress. Its power system comprises a large number of engines controlled by computers that are organized in an Internet-like computer network. The sea surface vehicle is unlimitedly scalable, practically unsinkable and exceptionally mobile and its draught is very shallow. Without changing itself, the sea surface vehicle can function as the bases of an aircraft carrier, a mobile sea surface airport, a heavy weapon group transport/landing ship, a comprehensive sea battle platform and a solar energy collection platform. An airplane takeoff/landing platform is made for airplanes to take off and land on it. The airplane takeoff/landing platform comprises a carrying board on which an airplane carries out takeoff and landing, a moving system on which the carrying board moves forward and backward, a thrusting system by which the carrying board is accelerated and a braking system by which the carrying board is decelerated. The airplane takeoff/landing platform provides a new approach of airplane's takeoff and landing. It significantly increases an airplane's survival probability when the airplane's landing gear does not work. It can actually function as a mobile airfield itself.

16 Claims, 7 Drawing Sheets

CELL-COMBINED LARGE SIZE SEA SURFACE VEHICLE AND AIRPLANE TAKEOFF/LANDING PLATFORM

FIELD OF THE INVENTION

The present invention relates to structure of large size sea surface vehicles, which include aircraft carrier, mobile sea surface airport, tank group and other heavy weapon group transport/landing ship and sea surface solar energy collection platform. The present invention also relates to airplane takeoff/landing assistant apparatus. Here and in the following, sea means the same water body as what ocean means.

BACKGROUND OF THE INVENTION

Study of the issues of limitations of current aircraft carriers and across sea mobility of tank group generated the present invention.

The first issue is about limitations of current aircraft carriers.

Mobile sea surface airports will be widely used in the future, along with predictable tremendous increase of human activity on sea surface in the future, which covers about seventy percent of the earth's surface. Today's aircraft carriers are not suitable for the main form of future mobile sea surface airports because of the following restrictions.

1. The structures and shapes of today's aircraft carriers are only suited for specifically designed airplanes. Most of today's airplanes that include commercial airplanes, military airplanes without specific apparatus and, specifically, large size airplanes can not use today's aircraft carriers.
2. The structures and shapes of today's aircraft carriers are hardly changeable after the aircraft carriers are built. New designs of the future airplanes that would be carried by aircraft carriers are subject to this disadvantageous restriction.
3. The structures and shapes of today's aircraft carriers require that the aircraft carriers must be built at very limited locations. This limitation is a very significant obstacle for competition and mass production.
4. The structures and shapes of today's aircraft carriers make maintenance and repair of these aircraft carriers complicated and expensive.

The second issue is about across sea mobility of tank group, including realization of striking power of heavy ground weapons on sea surface.

A group of tanks are very powerful in today's ground wars. However, today's ships that carry these tanks across sea generate the following concerns.

1. A today's ship that can transport a large number of tanks across sea depends on specific ports to load and unload these tanks. It lacks capacity of direct amphibious landing. A today's landing ship lacks capability of carrying a large number of tanks across sea. The lack of capacity of quick delivery of large-scale tank group from any seashore point to any seashore point across sea is a significant restriction on the use of large-scale tank group in the missions across sea.
2. A today's ship that can transport a large number of tanks across sea lacks the survivability that can match the survivability of the tank group on ground when the ship is under attack on sea surface. A few powerful missiles or bombs could sink the ship. Vulnerableness of the ship makes high survivability of the tank group on ground meaningless on sea surface.

3. A today's ship that can transport a large number of tanks across sea significantly restrains realization of fighting capability of these tanks on sea surface. In the ship, a tank is processed as a transported unit instead of a fighting unit. The valuable striking power of the tank group is wasted on sea surface.

The concerns above relate to very different fields. A common solution for all the concerns above has not been found in publication. Searching a common solution of all the concerns in the above two issues generated the following inventions.

SUMMARY OF THE INVENTION

The invention includes two parts. The first part is a cell-combined large size sea surface vehicle, which could be applied to aircraft carrier, mobile sea surface airport, tank group and other heavy weapon group transport/landing ship and sea surface solar energy collection platform. The second part is an aircraft takeoff/landing platform, which is an important part of a complete invention when just mentioned sea surface vehicle functions as an aircraft carrier or a mobile sea surface airport. The aircraft takeoff/landing platform can also be applied in land.

The present invented cell-combined large size sea surface vehicle is described as the following. The sea surface vehicle comprises a large number of cells. These cells are distributed along two horizontal dimensions on sea surface. Buoyancy is provided by the cells. These cells are connected to form the sea surface vehicle. Elasticity and flexibility are provided by the connection parts of the cells to prevent destructive stress. The elasticity and the flexibility can be restrained by rigid parts when rigidity is required. One or more engines can be installed inside or on the surface of any of the cells. Each engine is controlled by a computer that is organized in an Internet-like computer network. The assembly of the sea surface vehicle could be conducted on any sea surface. Because the structure of the sea surface vehicle is large and flat, it is also called a sea surface mobile platform.

The cell-combined large size sea surface vehicle or sea surface mobile platform shows the following especially useful characteristics.

First, its structure is combinative and unlimitedly scalable. Its surface area and load capacity could be easily added and reduced and its shape could be easily changed to meet special requirement simply by adjusting cells. Even the sea surface vehicles could be combined together to form a larger sea surface vehicle. The combination of the sea surface vehicles could easily create a super large sea surface vehicle. Its repair could be extremely quick by just changing damaged cells. Its production could be highly simple, rapid and economic because the cells could be manufactured anywhere in land and the assembly could be conducted on any sea surface.

Second, its structure is large and flat. Because the large quantity of the cells is distributed along two horizontal dimensions on sea surface, the sea surface vehicle could provide a large and flat platform. The unlimited scalability of the platform allows the platform to be large enough for all types of current and future airplanes to take off and land. The sea surface vehicle therefore could serve as a general-purpose aircraft carrier or mobile sea surface airport. The sea surface vehicle is naturally a sea surface airport for a large number of helicopters. Because the platform is large and flat, a large-scale tank group or other large-scale heavy weapon group could be deployed and maneuvered on the platform. Every tank or other heavy weapon on the platform could fully make use of its firing power on sea surface. Carrying a large number and a large variety of heavy weapons, the sea surface vehicle could function as a powerful comprehensive sea battle platform. Using the sea surface vehicle, army that traditionally fights on land can become a powerful battle force on sea surface.

Third, its survivability is extremely high. Each of the large number of the cells provides part of total buoyancy and the total buoyancy is the sum of the buoyancy of each individual cell. The cell could be made of light materials so that the buoyancy of each cell could be greater than its gravity in all the circumstances. The buoyancy of the sea surface vehicle could be made greater than its gravity in all circumstances. The combinative, large and flat structure and the large number of engines controlled by an Internet-like computer network make the survivability of the sea surface vehicle extremely high. A few explosive damages can not impact the function of the sea surface vehicle significantly.

Fourth, its draught is very shallow. The cells that provide floating forces are distributed along two horizontal dimensions on sea surface. The draught is basically less than the height of the cell, which could be very small. A tank group or other heavy weapon group therefore can quickly move on to the sea surface vehicle from land, be transported to another seashore and carry out an amphibious landing.

Fifth, its maneuverability is very high. Large number of engines and corresponding propellers could be installed. Each engine is controlled individually by a computer in a computer network. The number, installation position and power of the engines could be easily changed to meet specific requirement. The propellers can descend and change propelling direction. The sea surface vehicle therefore could be exceptionally mobile despite its large size.

When the sea surface vehicle functions as an aircraft carrier or mobile sea surface airport, additional airplane takeoff/landing assistant apparatus is greatly desired to reduce runway length and increase stability of the airplane's movement status. The following invention will make the present invention of the aircraft carrier and mobile sea surface airport, which are the applications of the sea surface vehicle, more effective and efficient. The application of the invented airplane takeoff/landing assistant apparatus is not limited on sea surface.

The present invented airplane takeoff/landing platform is described as the following. The airplane takeoff/landing platform comprises a carrying board, a moving system, a thrusting system and a braking system. When taking-off, an airplane moves on to the surface of the carrying board. The carrying board can move forward or backward on the moving system that either is installed on the runway ground or is installed on the lower surface of the carrying board. The carrying board moves forward under action of the thrusting system when the airplane uses its own thrust to take off. Protrusions that are installed on surface of the carrying board push the airplane when the airplane takes off. A certain part of takeoff momentum of the airplane is obtained from the carrying board. When landing, the airplane lands on the carrying board. There are two relative movements in the landing procedure. One is a relative movement between the airplane and the carrying board. The other is a relative movement between the carrying board and the ground. The relative movement between the airplane and the carrying board is stopped by friction between them or by protrusions on the carrying board. The relative movement between the carrying board and the ground is stopped by the braking system of the platform.

The airplane takeoff/landing platform shows the following especially useful characteristics.

First, it reduces required runway length. The thrusting system and the braking system of the platform make the airplane use shorter distance when taking-off and landing.

Second, it is suitable to all types of airplanes. Takeoff and landing on the platform do not require any specific apparatus for airplanes. The size and bearing capacity of the platform could be made to allow all types of airplanes to take-off and land.

Third, the movement of the carrying board can be precisely controlled. The precisely controlled movement of the carrying board is obtained by computers precisely controlling the thrusting force and braking force of the platform. The precisely controlled movement of the carrying board provides optimized takeoff/landing procedures for different types of airplanes.

Fourth, it increases airplane's safety when the airplane lands in bad conditions. The precisely controlled movement of the carrying board could make the airplane's moving status stable when landing. The increased stability would significantly increase airplane's safety when landing in bad conditions such as a strong wind or a heavy rain.

Fifth, it significantly reduces the danger in emergency landings that are caused by landing gear problems. An airplane sometimes can not lower its landing gear. The emergency landing from this problem could easily cause fire and breakup of the airplane. A precisely controlled movement of the carrying board provides a much safer emergency landing. The movement between the airplane and the carrying board can be reduced to minimum. The movement of the carrying board replaces the function of the airplane's wheels. The precisely controlled movement of the carrying board can hardly cause fire or breakup of the airplane.

Sixth, it can be used to build a mobile airfield. The platform can replace the traditional runway. The platform can be broken down into parts, be transported and then be assembled in another place.

The applications of the inventions above should be in very wide fields. The mentioned applications include aircraft carrier, mobile sea surface airport, tank-group transport/landing ship or other heavy weapon group transport/landing ship, comprehensive sea surface battle platform, mobile airfield and emergency-landing platform. The huge surface area, open and flat structure and the mobility of the sea surface vehicle make it suitable for another very important field, as described in the following.

The sea surface vehicle is an ideal solar energy collection platform. Solar energy collectors are installed on the surface of the sea surface vehicle. The large, open and flat structure and the mobility of the sea surface vehicle make it an ideal solar energy collection platform. Instead of staying in a permanent position, the sea surface vehicle could continuously adjust its position on the large scale of the sea to achieve the maximum efficiency. The collected solar energy is converted to electricity. The electric energy then is converted to stable chemical energy of hydrogen through electrolysis of water. The hydrogen provides a non-polluting energy for the later use.

DESCRIPTION OF THE PREFERRED EMBODIMENTS

A preferred embodiment of the cell-combined sea surface vehicle or sea surface mobile platform is described as the following.

The sea surface vehicle comprises a large number of cells. The cell is the element of the structure of the vehicle. The cell can be in any size and any shape and can be made by any kind of material. The only condition is that the cell should provide floating force for the sea surface vehicle. For economical reasons, a standard freight container is chosen to be the basis of the cell of the preferred embodiment. If the cell is wanted to provide floating force only, the space inside the container is fully filled with light material such as flame-retardant foam material. If the cell is wanted to provide both floating force and driving force, part of the space inside the container is filled with light material and the other part of the space is reserved for the engine and the fuel tank.

Figure 1:
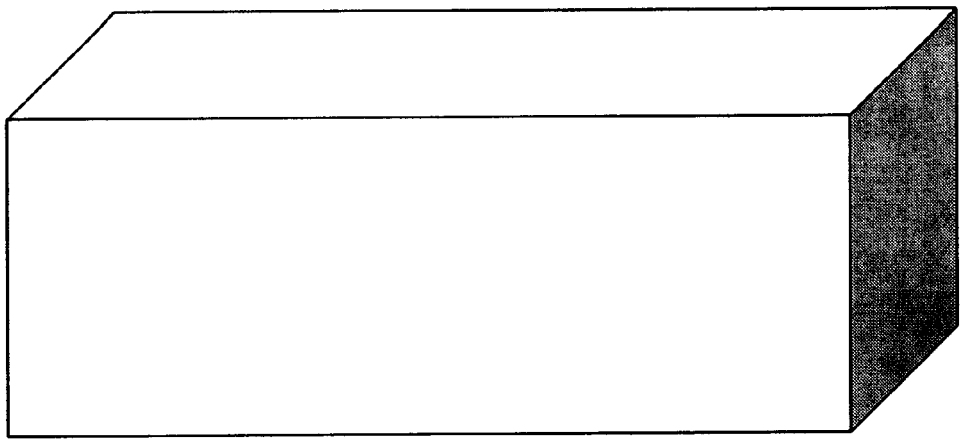
FIG. 1 shows a basic cell.
Figure 2:
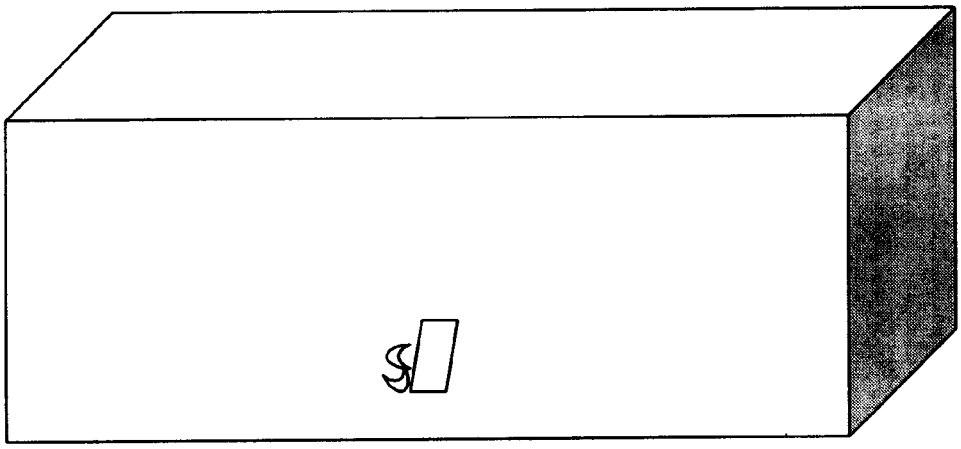
FIG. 2 shows a basic cell with an engine installed inside and two propellers and two wings symmetrically installed on the two sides.

A container filled with light material is called a basic cell for the convenience of description. FIG. 1 shows a basic cell. A basic cell can evolve into a more complicated cell. One or more engines can be installed inside a basic cell. One or more propellers can be installed on the left, right and bottom side of the basic cell. FIG. 2 shows a basic cell with an engine installed inside and two propellers and two wings symmetrically installed on the two sides.

A cover is installed on the top of the basic cell. The size of the cover is larger than the size of the top of the basic cell. If required, one or more engines can be installed on the cover to provide driving force.

Figure 3:
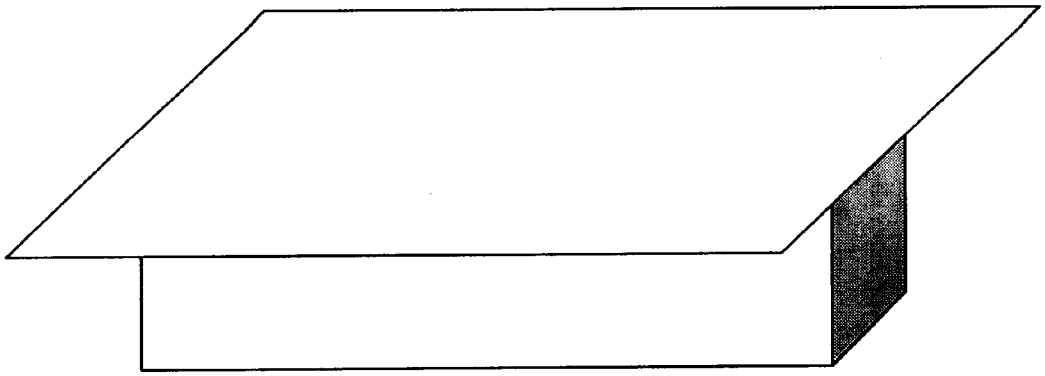
FIG. 3 shows a covered cell.
Figure 4:
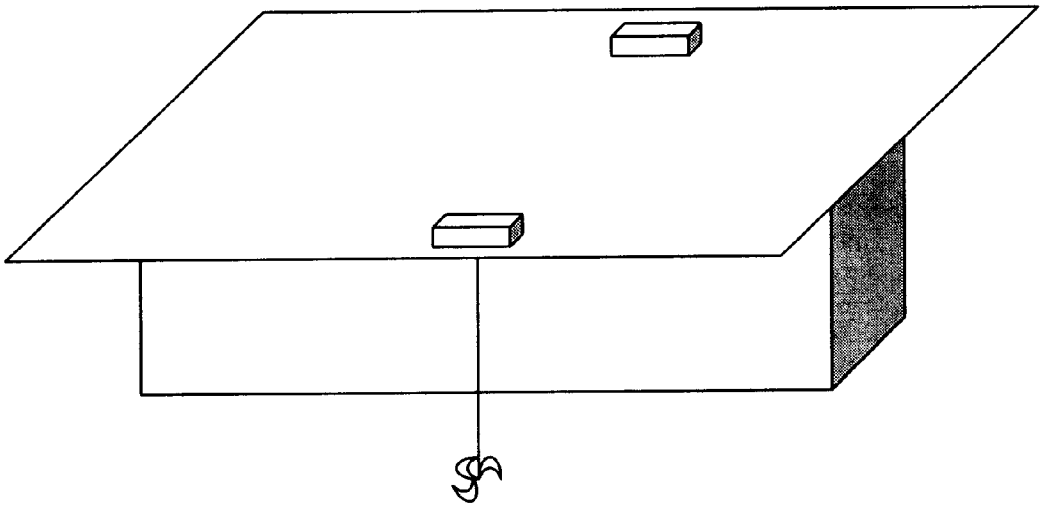
FIG. 4 shows a covered cell with two engines and two propellers symmetrically installed on the cover.

A cell with a cover is called a covered cell for the convenience of description. FIG. 3 shows a covered cell. FIG. 4 shows a covered cell with two engines and two propellers symmetrically installed on the cover. The propellers can be moved up and down. The propelling direction can be changed. The propellers are moved up in the situation of landing. The propellers are moved down to allow propelling force to act on all directions.

Figure 5:
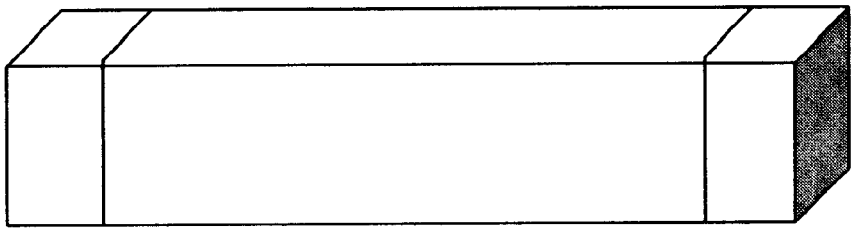
FIG. 5 shows a cell that comprises a basic cell and two elastic tubes that are installed on the two end sides of the basic cell.

The space between two basic cells in one column should be filled to reduce water resistance. In a typical embodiment, two elastic tubes are installed on the two end sides of the basic cell, as shown by FIG. 5. The tubes are ready to be connected with other tubes of other cells.

Figure 6:
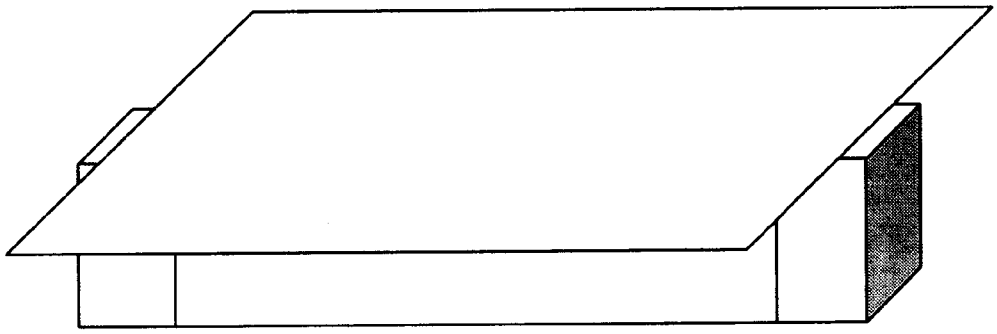
FIG. 6 shows a complete cell.

A cell with a cover on the top and two elastic tubes on the two end sides is called a complete cell for the convenience of description. FIG. 6 shows a complete cell. A complete cell can have engines but does not have to have engines.

The complete cells are ready to be connected together. Connection parts provide elasticity and flexibility to prevent destructive stress. In a typical embodiment, rectangular high elasticity steel plates are used to connect complete cells. Rigid parts can be added on connections to restrain the elasticity and the flexibility of the steel plates when rigidity is required.

Figure 7:
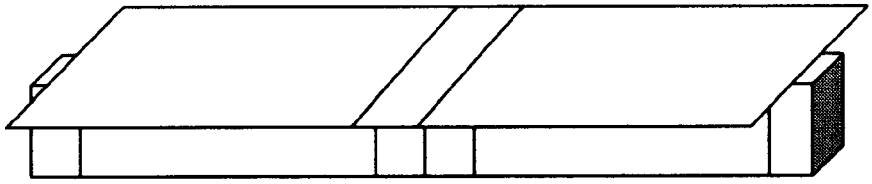
FIG. 7 shows that two complete cells are combined together.
Figure 8:
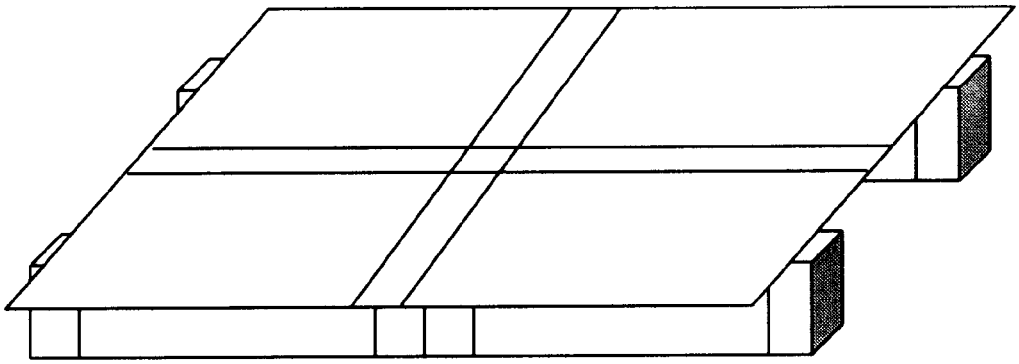
FIG. 8 shows that four complete cells are combined together.

These complete cells are connected along the two horizontal dimensions on sea surface. Construction of the sea surface vehicle is a process of combining more and more complete cells together. FIG. 7 shows that two complete cells are combined together and FIG. 8 shows that four complete cells are combined together. The process of connecting more and more complete cells makes complete cells evolve into a sea surface vehicle with any desired size and shape. The sea surface vehicle has virtually unlimited scalability.

Even two or more such sea surface vehicles can be combined together to form a larger sea surface vehicle. The combining process is reversible. A huge such sea surface vehicle can be resolved into two or more smaller sea surface vehicles. This reverse process is especially important when such sea surface vehicle is required to pass through a narrow watercourse such as a canal.

The power system of the sea surface vehicle comprises a large number of engines that are controlled by an Internet-like computer network. The engines can be installed inside the cells or on the covers. The installation position and the number of the engines depend on requirement. The number of the engines should be large to diversify risk and increase maneuverability. Each engine is controlled by a computer. All the computers are organized in the form of Internet-like computer network. The large number of engines and the Internet-like network make the power system extremely maneuverable and reliable.

The level of the propellers does not have to be above the level of the bottoms of the cells. One embodiment of propeller installation is that some propellers can be moved up and down and propelling force can act on any direction, as shown by FIG. 4. Such an implement of propeller installation makes the sea surface vehicle more maneuverable.

A preferred embodiment of the airplane takeoff/landing platform is described as the following.

The airplane takeoff/landing platform comprises a carrying board, a moving system, a thrusting system and a braking system.

An airplane carries out its takeoff and landing on the carrying board. When taking off, the airplane moves onto the surface of the carrying board. The carrying board can move forward or backward on the moving system that either is installed on the runway ground or is installed on the lower surface of the carrying board. In this preferred embodiment, the moving system is installed on the runway ground to make the inertia of the carrying board low. The carrying board is moved forward by the thrusting force of the thrusting system when the airplane uses its own thrust to take off. Protrusions that are installed on surface of the carrying board push the airplane when the airplane takes off.

A certain part of takeoff momentum of the airplane is obtained from the carrying board. When landing, the airplane lands on the carrying board. There are two relative movements in the landing procedure. One is a relative movement between the airplane and the carrying board. The other is a relative movement between the carrying board and the ground. The relative movement between the airplane and the carrying board is stopped by friction between them or by protrusions on the carrying board. The relative movement between the carrying board and the ground is stopped by the braking system of the platform.

Figure 9:
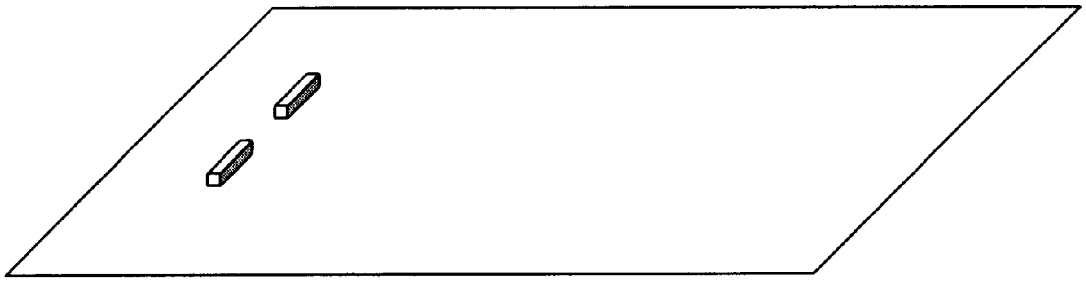
FIG. 9 shows a carrying board on which airplanes take off and land.

A typical implement of the carrying board is shown by FIG. 9. The carrying board is in a rectangular shape. The material of the carrying board should be as light as possible to reduce the inertia of the carrying board. The carrying board has a high friction coefficient upper surface and a low friction coefficient lower surface. The high friction coefficient upper surface and the low inertia of the carrying board are important to minimize the relative movement between the airplane and the carrying board when the airplane lands. The low friction coefficient lower surface makes the whole system more effective and efficient. When used in a cell-combined sea surface vehicle, the carrying board is made flexible because the sea surface vehicle is flexible. The protrusions on the carrying board push the rear wheels of the airplane when the airplane takes off and obstruct the rear wheels of the airplane when the airplane lands. The gap between the two protrusions allows the front wheel of the airplane to pass through when the airplane lands. The protrusions are movable to allow the front wheel of airplane to pass through and stop the rear wheels of the airplane in the situation that the front wheel of the airplane is not in the center of the carrying board when the airplane lands. The protrusions are movable also to allow the airplane more easily to be maneuvered on the carrying board.

Figure 10:
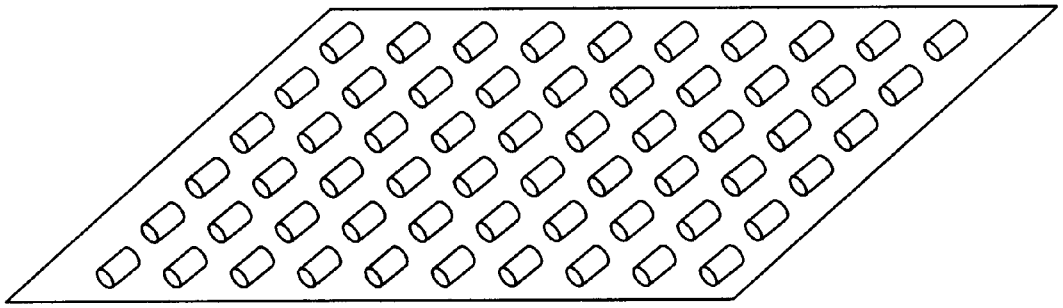
FIG. 10 shows a number of ball bearings that are installed on a rectangular plate.
Figure 11:
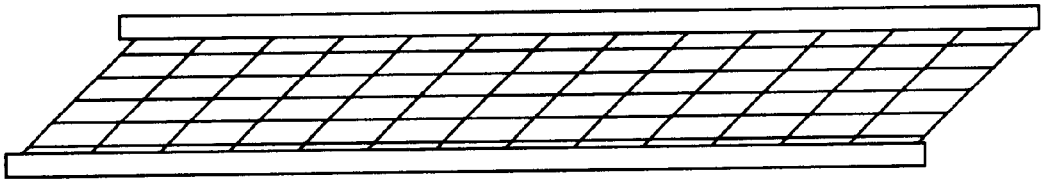
FIG. 11 shows a moving system that comprises ball bearings, which are installed on rectangular plates, and guides.
Figure 12:
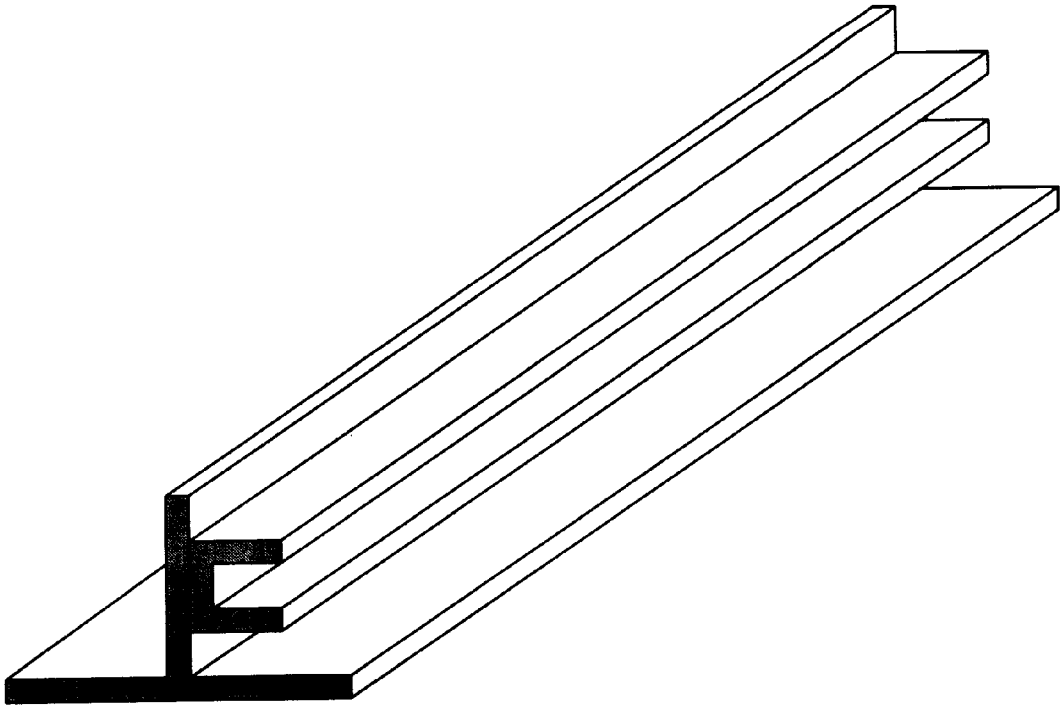
FIG. 12 shows a section of a detailed guide.

The moving system comprises ball bearings and guides. The ball bearings provide support and rotating friction for the carrying board. A typical implement is that a certain number of ball bearings are installed on a rectangular plate, as shown by FIG. 10, and the plates are set on the ground between two guides to form a runway, as shown by FIG. 11. The guides are set on the two sides of the runway to guide the movement of the carrying board. The guides also provide ground to install brakes. FIG. 12 shows a typical implement of the guide. The edge of the carrying board moves in the groove of the guide.

Figure 13:
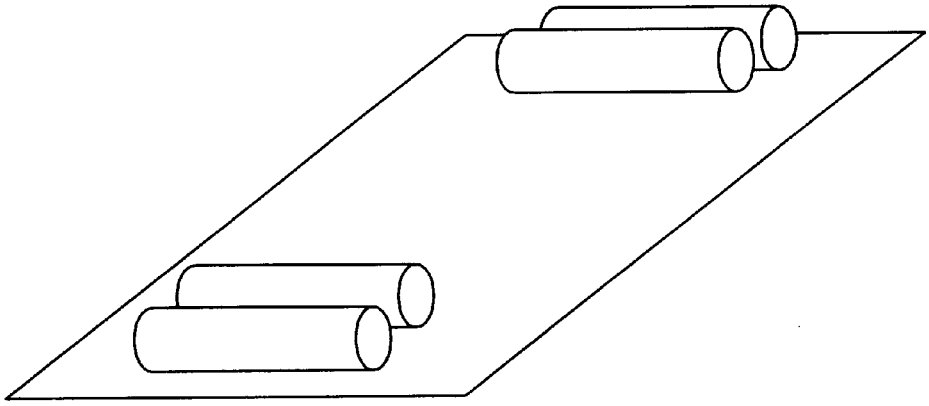
FIG. 13 shows a thrusting system that comprises four jet engines and a board.

The thrusting system comprises a certain number of engines. The engines accelerate the carrying board and the airplane when the airplane takes off. A typical implement of the thrusting system is shown by FIG. 13, where four jet engines are installed on a board. The board of the thrusting system is called a trusting board for the convenience of description. The number of the engines is not limited. In the case of takeoff, the thrusting board is connected with and pulls the carrying board that carries the airplane. The thrusting power and its action procedure of the thrusting system can be precisely controlled by computers. In the case of landing, the thrusting board is separated from the carrying board to reduce the inertia of the carrying board.

Figure 14:
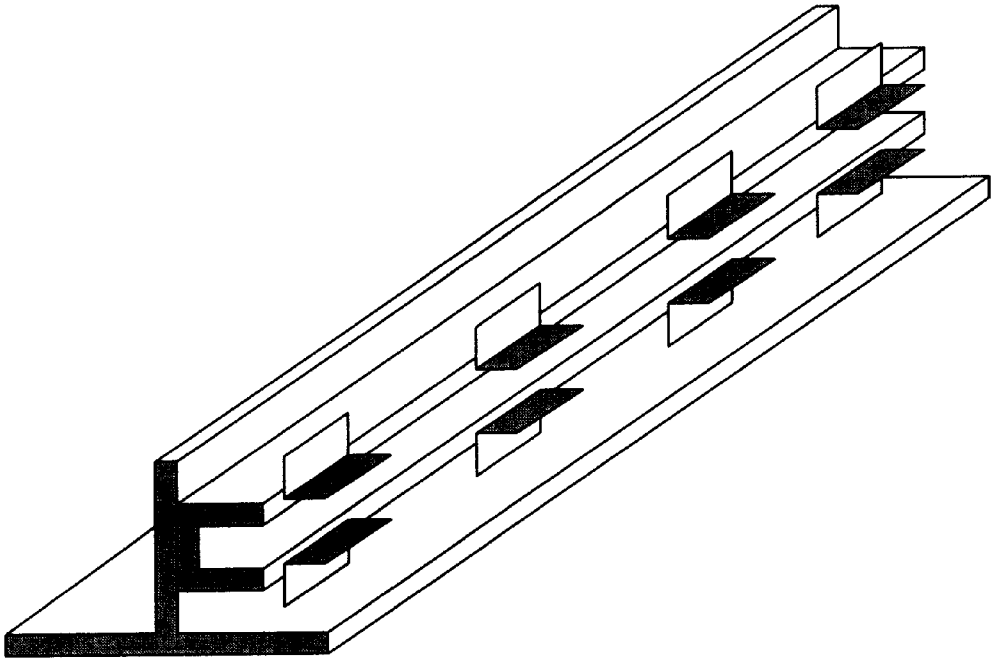
FIG. 14 shows four pairs of brakes that are installed on a section of a guide.

The braking system comprises brakes and a brake control system. The braking force stops the movement of the carrying board that carries the airplane. A typical implement of the braking system is shown by FIG. 14. The brakes are built in pairs and are installed on the guides. The edges of the carrying board pass through the space of each pair of the brakes. When braking force is required, the brakes press from both sides of the carrying board. The programmed control system controls the timing and the braking force of each pair of the brakes based on the speed and position of the carrying board and the airplane.

The present invention of the sea surface vehicle or sea surface mobile platform can be applied to many different fields to be a new and useful machine in each specific field. Six such new and useful machines in six specific fields are described as the following. When the sea surface vehicle only functions as a new and useful machine in each specific field, the sea surface vehicle does not change itself. Figures of these new and useful machines as the applications of the sea surface vehicle therefore are not provided.

The first is an aircraft carrier. The flat structure and unlimited scalability of the sea surface vehicle allow all types of airplanes to take off and land on it. The sea surface vehicle is mobile and can carry airplanes. The sea surface vehicle can function as an aircraft carrier without specific takeoff/landing assistant apparatus. If the present invention of airplane takeoff/landing platform is used, the aircraft carrier is more effective and efficient.

The second is a mobile sea surface airport. The flat structure and unlimited scalability of the sea surface vehicle allow all types of airplanes to take off and land on it. The sea surface vehicle is mobile and can carry airplanes. The sea surface vehicle can function as a mobile sea surface airport without specific takeoff/landing assistant apparatus. If the present invention of airplane takeoff/landing platform is used, the mobile sea surface airport is more effective and efficient.

The third is a heavy weapon group transport/landing ship. The structure of the sea surface vehicle is flat so that the height of the sea surface vehicle is basically the height of the cell. The draught of the sea surface vehicle is less than the height of the sea surface vehicle so that the draught of the sea surface vehicle is very shallow. Tanks and other heavy weapons can directly move on to the sea surface vehicle from seashore, be transported and then carry out amphibious landing in another seashore. The unlimited scalability of the sea surface vehicle allows it to carry a large scale tank group or other large scale heavy weapon groups.

The fourth is a comprehensive sea surface battle platform. The flat structure and unlimited scalability of the sea surface vehicle allow a large number and a large variety of weapons to be deployed on it to carry out various sea battle missions. The structure of the sea surface vehicle is highly risk diversified so that it especially suitable for battle missions.

The fifth is a sea surface estate foundation. A sea surface estate foundation provides foundations on which estates can be developed. Its scalability and flat structure allow variety of estates to be developed on it. Its ability for airplanes to take off and land and its mobility are the special characteristics of the sea surface estate foundation.

The sixth is a sea surface solar energy collection platform. The energy per area unit of solar energy is relatively small. The location for maximum efficiency of solar energy collection on sea surface keeps changing. Therefore, the scalability, flat structure and mobility of the sea surface vehicle make it especially suitable to collect solar energy on sea surface. Because water is always available on sea surface, a process to produce and store energy by using the sea surface solar energy collection platform is introduced. The process comprises the steps of obtaining electricity from the solar energy collectors installed on the solar energy collection platform and then producing hydrogen by using obtained electricity via electrolysis.

What is claimed is:

1. A sea surface vehicle or sea surface mobile platform combined by cells through a procedure of connecting a plurality of separately manufactured and separately floatable cells, said sea surface vehicle or sea surface mobile platform being with the following structure and characteristics:

a) said a plurality, defined arbitrarily as being equal to or greater than twelve, of separately manufactured and separately floatable cells distributed along two horizontal dimensions on sea surface;

b) said cell having a top cover plate or top cover plates connectable with other top cover plate or top cover plates of other said cells;

c) whole structure of said sea surface vehicle or sea surface mobile platform being with flexibility formed by combinational action of flexibility possessed by said top cover plates and/or their connection parts;

d) each individual one of a plurality, defined arbitrarily as being equal to or greater than six in absolute number or greater than ten percent of total said cells, of said cells separately providing propelling power for whole said sea surface vehicle or sea surface mobile platform through engines and related propellers installed in and/or on each of said a plurality of said cells;

e) a computer network with Internet-like network structure controlling operation of said engines and related propellers.

2. The sea surface vehicle or sea surface mobile platform combined by cells of claim 1, wherein a number of propellers of the power system capable of descending and changing propelling directions.

3. The sea surface vehicle or sea surface mobile platform combined by cells of claim 1, said sea surface vehicle or sea surface mobile platform functioning as an aircraft carrier.

4. The sea surface vehicle or sea surface mobile platform combined by cells of claim 1, said sea surface vehicle or sea surface mobile platform functioning as a mobile sea surface airport.

5. The sea surface vehicle or sea surface mobile platform combined by cells of claim 1, said sea surface vehicle or sea surface mobile platform functioning as a heavy weapon group transport/landing ship.

6. The sea surface vehicle or sea surface mobile platform combined by cells of claim 1, said sea surface vehicle or sea surface mobile platform functioning as a comprehensive sea surface battle platform.

7. The sea surface vehicle or sea surface mobile platform combined by cells of claim 1, said sea surface vehicle or sea surface mobile platform functioning as a sea surface estate foundation.

8. The sea surface vehicle or sea surface mobile platform combined by cells of claim 1, said sea surface vehicle or sea surface mobile platform functioning as a sea surface solar energy collection platform.

9. A process to produce and store energy by using said sea surface vehicle or sea surface mobile platform combined by cells of claim 1, said process comprising the steps of:

a) obtaining electricity from said solar energy collectors installed on said sea surface vehicle or sea surface mobile platform combined by cells of claim 1;

b) producing hydrogen by using obtained electricity via electrolysis.

10. An airplane takeoff/landing platform, said airplane takeoff/landing platform comprising:

a) carrying board on which an airplane carries out takeoff and landing;

b) moving system on which said carrying board moves forward and backward;

c) thrusting system by which said carrying board is accelerated;

d) braking system by which said carrying board is decelerated.

11. A carrying board as defined in claim 10, said carrying board comprising:

a) a board with a high friction coefficient upper surface and a low friction coefficient lower surface;

b) protrusions installed on upper surface of said board to push rear wheels of an airplane when said airplane takes off and obstruct rear wheels of an airplane when said airplane lands.

12. A moving system as defined in claim 10, said moving system comprising:

a) ball bearings installed on runway;

b) guides that guide movement of said carrying board as defined in claim 10.

13. A moving system as defined in claim 10, said moving system comprising wheels that are installed on lower surface of said carrying board as defined in claim 10.

14. The moving system of claim 12, wherein said ball bearings are installed on rectangular plates and said rectangular plates are set to form runway.

15. A thrusting system as defined in claim 10, said thrusting system comprising a number of jet engines.

16. A braking system as defined in claim 10, said braking system comprising a number of brakes to press on edges of said carrying board as defined in claim 10.

* * * * *